United States Patent [19]

Hansen

[11] 4,345,441

[45] Aug. 24, 1982

[54] DEFROSTER FOR THE EVAPORATOR OF A REFRIGERATOR

[75] Inventor: Børge M. Hansen, Sønderborg, Denmark

[73] Assignee: Danfoss A/S, Nordborg, Denmark

[21] Appl. No.: 222,668

[22] Filed: Jan. 5, 1981

[30] Foreign Application Priority Data

Jan. 20, 1980 [DE] Fed. Rep. of Germany ..... 3001019

[51] Int. Cl.[3] ..... F25D 21/02; F25D 21/06

[52] U.S. Cl. ..... 62/140; 62/156

[58] Field of Search ..... 62/140, 156, 128

[56] References Cited

U.S. PATENT DOCUMENTS

| | | | |
|---|---|---|---|
| 2,075,437 | 3/1937 | Hainsworth | 62/140 |
| 2,117,104 | 5/1938 | Rorison | 62/156 X |
| 2,669,848 | 1/1954 | Fujii | 62/140 X |
| 2,744,389 | 5/1956 | Raney | 62/140 |

*Primary Examiner*—Albert J. Makay
*Assistant Examiner*—Harry Tanner
*Attorney, Agent, or Firm*—Wayne B. Easton

[57] ABSTRACT

The invention relates to defroster control apparatus for the evaporator of a refrigerator. A frost sensor for measuring temperature is mounted a predetermined distance from a surface of the evaporator which corresponds to the permissible thickness of frost layer. Control apparatus including a comparator circuit initiates defrosting when the frost sensor temperature falls below a reference temperature. In this construction the frost layer grows in the direction of the frost sensor which is swept by the surrounding air. During each operating cycle the frost sensor initially measures a temperature approximating to the surrounding temperature. As the frost progressively increases, this temperature falls because the air circulation in the vicinity of the frost sensor is progressively more influenced as the thickness of the frost layer increases. In the extreme case, the frost sensor can come into contact with the frost layer. Depending on the choice of reference temperature, defrosting can therefore be initiated when the frost layer screens the frost sensor to a predetermined degree from the surrounding air or has made contact with the frost sensor.

1 Claim, 7 Drawing Figures

DEFROSTER FOR THE EVAPORATOR OF A REFRIGERATOR

The invention relates to a defroster for the evaporator of a refrigerator, comprising a control apparatus which initiates defrosting and comprises a frost sensor responsive to the presence of a frost layer.

In a known defroster of this kind, there is an optical system in which a light-sensitive element serving as the frost sensor is exposed to a light source. An incident surface of the optical system is so thermally conductively connected to the evaporator that it becomes coated with a frost layer substantially conforming to the surface of the evaporator. This reduces the radiation striking the frost sensor. This is utilised to initiate defrosting. This defroster operates inaccurately and is prone to faults because unavoidable soiling simulates a frost layer and the heat of the light source permits the frost to melt.

In practice, therefore, defrosting is not initiated with the aid of a sensor responsive to the presence of a frost layer but as a result of any data which lead one to suspect the presence of a frost layer. Thus, defrosters operate in response to a time or programme control, in response to the number of door movements, the number of compressor starts or a particular operating time of the compressor. Initiations of this kind are necessarily inaccurate and consequently defrosting is initiated too frequently or too seldom.

Another kind of indirect initiation is typified by a defroster in which the evaporator temperature and the temperature in the refrigerated space are measured and an evaluating circuit checks whether the measuring result is disposed on the one or other side of a particular characteristic curve. With measurements on the one side of the characteristic curve, it is assumed that a frost layer is present. In this case, thermistors serve as temperature sensors.

The invention is based on the problem of providing a defroster of the aforementioned kind which operates more accurately and is less prone to faults.

This problem is solved according to the invention in that the frost sensor is a temperature sensor which is disposed at a spacing from a surface of the evaporator corresponding to the permissible thickness of frost layer and that the control apparatus comprises a comparator circuit which initiates defrosting when the frost sensor temperature falls below a reference temperature.

In this construction, the frost layer grows in the direction of the frost sensor which is swept by the surrounding air. During each operating cycle, therefore, the frost sensor initially measures a temperature approximating to the surrounding temperature. As the frost progressively increases, this temperature falls because the air circulation in the vicinity of the frost sensor is progressively more influenced as the thickness of the frost layer increases. In the extreme case, the frost sensor can even come into contact with the frost layer. Depending on the choice of reference temperature, defrosting can therefore be initiated when the frost layer screens the frost sensor to a predetermined degree from the surrounding air or has made contact with the frost sensor.

Desirably, the surface of the evaporator is vertical. The frost sensor will then be disposed in a continuous air flow even in the case of evaporators without frost air flow.

It is particularly favourable to provide a second sensor which measures the evaporator temperature to form the reference temperature. The reference temperature will then not have a constant value but will change with the evaporator temperature which, in turn, is subjected to fluctuations during each operating cycle and also assumes different values depending on the temperature set for the refrigerated space. In all cases, however, it will be ensured that the comparison circuit responds when the frost layer which has substantially the same temperature as the evaporator approaches the frost layer sensor.

The frost sensor and the second sensor may be closely juxtaposed to result in a space-saving construction.

More particularly, the second sensor may be a contact sensor and both sensors may be disposed in a common sensor holder of thermally insulating material. In a single assembly step, therefore, the frost sensor will be installed at the correct spacing from the evaporator and the second sensor will be installed in contact with the evaporator surface.

In a preferred embodiment, the frost sensor is disposed in a depression of a guide surface extending at a spacing from the surface of the evaporator. Together with the evaporator wall, the guide surface forms a passage through which the surrounding air can flow. The cross-section of this passage is reduced as the frost layer increases. Consequently, the temperature of the frost sensor will not only fall because it is more intensively cooled by the approaching frost layer but also because it is progressively less heated by the surrounding air. This results in a very steep temperature drop for the frost sensor when the frost layer approaches same.

A particularly simple construction is obtained if the sensor holder comprises a contact face which is adapted to abut the vertical surface of the evaporator and has a depression for receiving the second sensor and adjoining the guide surface by way of a step. The step should extend in the direction of the air flow so that sweeping of the surrounding air along the frost sensor cannot be impeded by anything other than the frost layer.

For this purpose it is also advisable for the space above and below the frost sensor to be free from built-in components.

Further, the holder may be provided with recesses for receiving conductor connections leading to the sensors. This results in a compact unit which is easy to install.

A similar result is obtained if the conductor connections leading to the sensors are in the form of a printed circuit.

Desirably, the conductor connections leading to the sensors extend close to the evaporator. The conductor connections are therefore cooled before reaching the temperature sensors. They can therefore not act as heat conductors for conveying heat to and influencing the temperature of the sensors from outside the refrigerated space where, for example, the electric circuit arrangement is accommodated.

Suitable sensors are for example thermistors or thermocouples.

It is also favourable to have an evaluating circuit which evaluates the sensor temperatures each time the compressor of the refrigerator is switched on or off. In this way one can leave fluctuations of the evaporator temperature occurring during an operating cycle out of consideration. The evaluating circuit may be disposed in the sensor holder. This saves space.

A preferred example of the invention will now be described in more detail with reference to the drawing, wherein.

Figure 1:
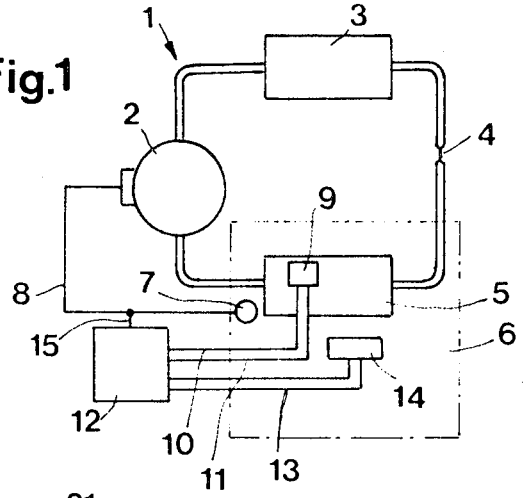
FIG. 1 is a diagrammatic representation of a refrigerator with defroster.
Figure 2:
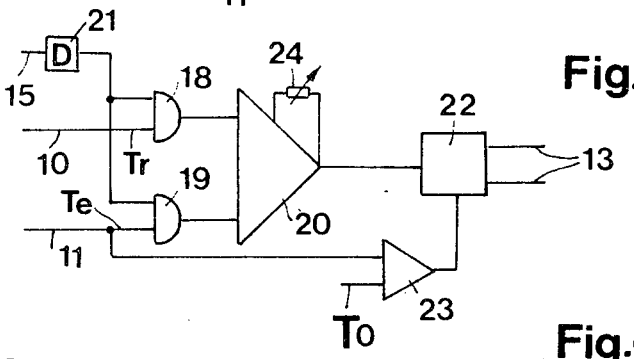
FIG. 2 is a much simplified circuit diagram of a comparator circuit.

The refrigerator 1 of FIG. 1 comprises a compressor 2 which feeds refrigerant to a condenser 3. The latter is connected to an evaporator 5 by way of a throttle 4. The evaporator outlet leads to the suction side of the compressor 2. The evaporator is disposed in a refrigerated space 6 of, for example, a refrigerator or freezer. In this refrigerated space there is a thermostat 7 connected by a conduit 8 to the compressor 2 which it switches on when a set temperature for the refrigerated space is exceeded and off when the temperature falls below a second lower temperature.

Secured to the compressor there is a sensor holder 9 connected by conductors 10 and 11 to a defroster circuit 12. The latter is connected by conductors 13 to a defroster 14 in the refrigerated space 6. In the present example, the defroster is in the form of an electrical heating resistor. It may, however, be of any other known form, for example formed by warm refrigerant being led through the evaporator 5. Further, it will be evident that the conductor 8 is connected to the defrosting circuit 12 by way of a branch line 15.

The sensor holder 9 contains two sensors, namely a frost sensor 16 and a second sensor 17 which measures the evaporator temperature and will be explained hereinafter. By way of the conductor 10, the defrosting circuit 12 is fed with a signal which corresponds to the frost sensor temperature Tr and by way of the conduit 11 with a signal which corresponds to the evaporator temperature Te. These signals are applied to the inputs of a comparator 20 by way of a respective AND element 18 or 19. The AND circuits 18 and 19 are in addition supplied with a signal from the conductor 15 by way of a differentiating element 21. This signal occurs whenever the compressor 2 receives a start signal from the thermostat 7. Consequently, a comparison of temperature takes place in the comparator 20 on each commencement of an operating cycle of the compressor 2. If the frost sensor temperature Tr falls below a reference temperature depending on the evaporator temperature Te, the comparator 20 will operate a switching apparatus 22 with which the defroster 14 is operated for as long as the evaporator temperature Te has risen beyond the melting point of the ice. For this purpose there is a second comparator 23 which compares the signal corresponding to the evaporator temperature Te with a melting point temperature To and, when it responds, switches off the switching apparatus 22. An adjustable resistor 24 serves to set a reference value which exceeds the evaporator temperature Te by a predetermined amount.

Figure 3:
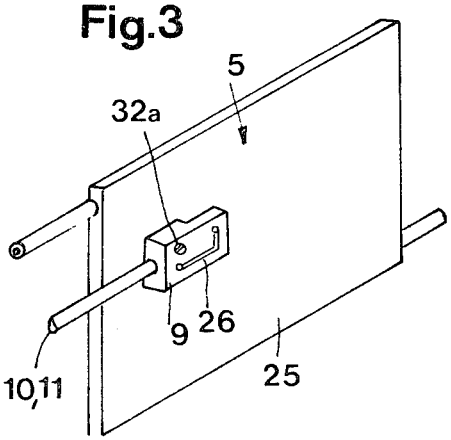
FIG. 3 is a pictorial representation of a first embodiment for applying a sensor holder to the evaporator.

In FIG. 3, the evaporator 5 is shown as a plate evaporator to the vertical front face 25 of which the sensor holder 9 is secured by a screw 32*a*. The construction of this sensor holder corresponds to that of FIGS. 4 to 6 except that connecting conductors are provided at the back in the form of a printed circuit 26.

Figure 4:
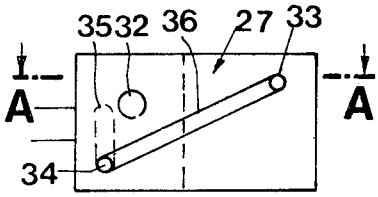
FIG. 4 is a rear view of a second embodiment of a sensor holder.
Figure 5:
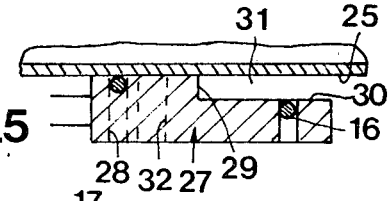
FIG. 5 is a horizontal section on the line A—A in FIG. 4.
Figure 6:
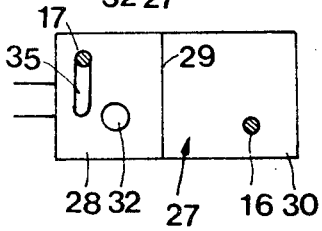
FIG. 6 is a view of the sensor holder from the side abutting the evaporator.

In FIGS. 4 to 6, a sensor holder 27 is shown. It comprises a contact surface 28 and a guide surface 30 which is connected thereto by way of a step 29 and which, together with the vertical face 25 of the evaporator 5, forms a passage 31. A bore 32 serves for the passage of the screw 32*a*. The frost sensor 16 is disposed in a bore 33 and the contact sensor 17 in a bore 34, both being in the form of a temperature sensor. A channel 35 in the contact surface 28 accommodates the conductors 10 and 11 leading to the temperature sensor 17. At this position, the conductors 10 and 11 are cooled so that no heat can reach the temperature sensor 17 from beyond the refrigerated space 6. Alternatively, it is also often sufficient to arrange the supply cable leading to the sensor holder closely against the evaporator surface 25. The rear sides of both bores 34 and 33 are interconnected by way of a channel 36 through which connecting conductors 10 are passed to the frost sensor 16.

Figure 7:
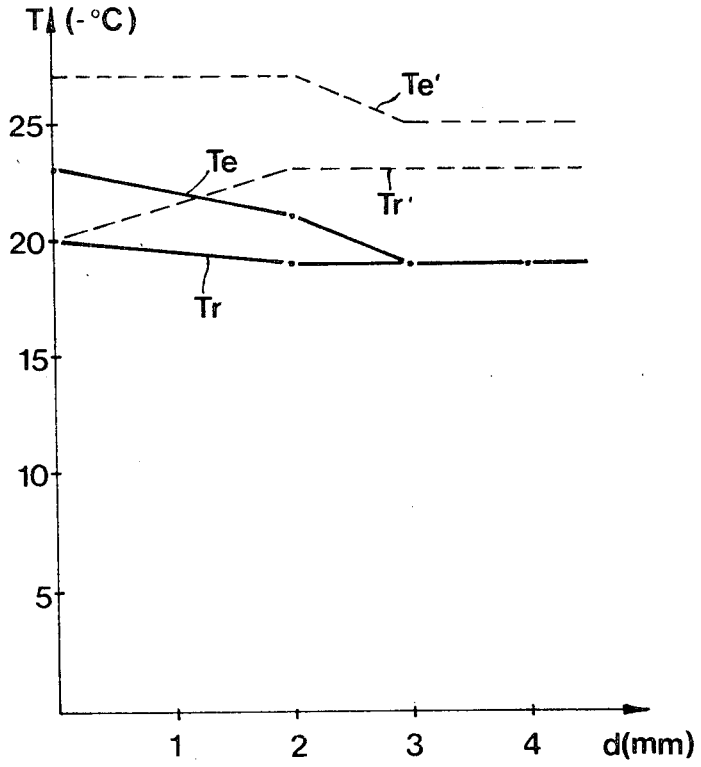
FIG. 7 is a graph of the temperature of the frost sensor and the second sensor against the thickness of the frost layer.

FIG. 7 shows how the evaporator temperature Te and the frost sensor temperature Tr varies in relation to the thickness d of the frost layer which forms on the surface 25 beyond the sensor holder 27 and thereby influences the air circulation through the passage 31. The measurements were in each case made on switching on of the compressor 2. It will be seen that the difference between these two temperatures decreases gradually up to a frost layer thickness of 2 mm and subsequently more steeply until they are equal from 3 mm. This applies to a depth of 2 mm for the passage 31. The corresponding temperatures Te' and Tr' for the switching off point of the compressor 2 are shown in broken lines. They are at a somewhat lower temperature level and approach each other up to a difference of 2° C. In both cases it is possible, particularly in the zone between 2 and 3 mm of layer thickness, to set a difference between the evaporator temperature Te and the frost sensor temperature Tr where, when the temperature falls below same, the defroster is actuated, which instant corresponds to an accurately defined frost layer thickness. If it is desired to monitor frost layer thicknesses other than 2 to 3 mm, it is sufficient to select an appropriate depth of passage.

From the curves it will also be seen that the frost sensor temperature initially fluctuates only slightly because it predominantly depends on the surrounding air. However, as the frost layer progressively screens the frost sensor more and more from the circulation of air, the frost sensor temperature will more closely follow the temperature fluctuations of the evaporator during the switching on and switching off period.

What is claimed is:

1. A refrigerator assembly comprising, thermostat and compressor means, an evaporator, a frost sensor spaced a predetermined distance from said evaporator corresponding to a permissible frost layer thickness, a second sensor abutting said evaporator for measuring evaporator temperature, evaporator defroster means, first comparator means monitoring said sensors to turn on said defroster means when said evaporator temperature equals the temperature of said frost sensor, second comparator means overriding said first comparator means monitoring said second sensor and a reference ice melting point temperature to maintain said defrosting means in an off condition while said evaporator temperature exceeds said melting point temperature, and means enabling said first comparator means each time said thermostat means initiates actuation of said compressor means.

* * * * *